US010957985B2

(12) United States Patent
Paulotto et al.

(10) Patent No.: US 10,957,985 B2
(45) Date of Patent: Mar. 23, 2021

(54) ELECTRONIC DEVICES HAVING ANTENNA MODULE ISOLATION STRUCTURES

(71) Applicant: Apple Inc., Cupertino, CA (US)

(72) Inventors: Simone Paulotto, Redwood City, CA (US); Qishan Yu, San Jose, CA (US); Harish Rajagopalan, San Jose, CA (US); Berke Cetinoneri, Santa Clara, CA (US)

(73) Assignee: Apple Inc., Cupertino, CA (US)

( * ) Notice: Subject to any disclaimer, the term of this patent is extended or adjusted under 35 U.S.C. 154(b) by 400 days.

(21) Appl. No.: 16/146,488

(22) Filed: Sep. 28, 2018

(65) Prior Publication Data

US 2020/0106185 A1 Apr. 2, 2020

(51) Int. Cl.

| | |
|---|---|
| ***H01Q 1/38*** | (2006.01) |
| ***H01Q 11/14*** | (2006.01) |
| ***H01Q 3/44*** | (2006.01) |
| ***H01Q 1/42*** | (2006.01) |

(52) U.S. Cl.

CPC ..... *H01Q 11/14* (2013.01); *H01Q 1/38* (2013.01); *H01Q 1/422* (2013.01); *H01Q 3/443* (2013.01)

(58) Field of Classification Search

CPC ..... H01Q 11/14; H01Q 1/38; H01Q 1/422; H01Q 3/443

See application file for complete search history.

(56) References Cited

U.S. PATENT DOCUMENTS

| | | | |
|---|---|---|---|
| 4,924,236 | A | 5/1990 | Schuss et al. |
| 9,667,290 | B2 | 5/2017 | Ouyang et al. |
| 2004/0113840 | A1 | 6/2004 | Gottwald et al. |
| 2004/0246187 | A1 | 12/2004 | Hara et al. |
| 2016/0344093 | A1 | 11/2016 | Tagi et al. |

FOREIGN PATENT DOCUMENTS

| | | | |
|---|---|---|---|
| CN | 102176537 | A | 9/2011 |
| CN | 102377021 | A | 3/2012 |
| CN | 103367893 | A | 10/2013 |
| CN | 103688599 | A | 3/2014 |

(Continued)

OTHER PUBLICATIONS

Noori et al., U.S. Appl. No. 15/655,727, filed Jul. 20, 2017.

(Continued)

*Primary Examiner* — Graham P Smith

(74) *Attorney, Agent, or Firm* — Treyz Law Group, P.C.; Michael H. Lyons

(57) ABSTRACT

An electronic device may be provided with a phased antenna array controlled by phase and magnitude controllers within an integrated circuit. The array may be formed on antenna layers and the integrated circuit may be mounted to transmission line layers of a dielectric substrate. A ground plane may separate the transmission line layers from the antenna layers. A connector may be mounted to the surface of the transmission line layers and may be coupled to the integrated circuit using conductive traces. A passive resonator may be formed in the antenna layers and may include conductive structures that resonate at one-quarter of the effective wavelength of operation of the array to form an open circuit impedance for surface currents generated on the ground plane by the array. This may serve to block the surface currents from scattering at an edge of the ground plane and leaking onto the integrated circuit.

20 Claims, 10 Drawing Sheets

(56) References Cited

FOREIGN PATENT DOCUMENTS

| | | | |
|---|---|---|---|
| CN | 106910999 | A | 6/2017 |
| CN | 107732415 | A | 2/2018 |
| CN | 207459171 | U | 6/2018 |
| CN | 207518637 | U | 6/2018 |
| CN | 108281781 | A | 7/2018 |
| EP | 279050 | A1 | 12/1987 |
| EP | 2610964 | A1 | 7/2013 |
| EP | 3185361 | A1 | 10/2015 |
| KR | 1020110120090 | A | 11/2011 |
| KR | 101743920 | B1 | 6/2017 |
| WO | 2016003173 | A1 | 1/2016 |

OTHER PUBLICATIONS

Zhao et al., 5G Novel Antenna Technology Research, Telecommunications Technology, Jan. 2, 2018, pp. 117-124, Issue 11.

Wang et al., A Second Order Decoupling Design Using a Resonator and an Interdigital Capacitor for a MIMO Antenn. Pair, Progress in Electromagnetics Research Letters, Dec. 31, 2017, pp. 19-24, Vol. 67.

ELECTRONIC DEVICES HAVING ANTENNA MODULE ISOLATION STRUCTURES

BACKGROUND

This relates generally to electronic devices and, more particularly, to electronic devices with wireless communications circuitry.

Electronic devices often include wireless communications circuitry. For example, cellular telephones, computers, and other devices often contain antennas and wireless transceivers for supporting wireless communications.

It may be desirable to support wireless communications in millimeter wave and centimeter wave communications bands. Millimeter wave communications, which are sometimes referred to as extremely high frequency (EHF) communications, and centimeter wave communications involve communications at frequencies of about 10-300 GHz. In order to support millimeter and centimeter wave communications, an array of antennas is formed on a substrate. Transmission lines for the array are embedded within the substrate.

Operation at these frequencies may support high bandwidths, but may raise significant challenges. For example, it can be difficult to ensure that amplifier circuitry and other radio-frequency components on the substrate are sufficiently isolated from surface currents generated by the antennas. Spreading the radio-frequency components on the substrate far apart from each other typically improves isolation. However, at the same time, manufacturers are continually striving to implement wireless communications circuitry such as antenna arrays using compact structures to satisfy consumer demand for small form factor wireless devices.

It would therefore be desirable to be able to provide electronic devices with improved wireless communications circuitry such as communications circuitry that supports millimeter wave communications.

SUMMARY

An electronic device may be provided with wireless circuitry. The wireless circuitry may include one or more antennas and transceiver circuitry such as centimeter and millimeter wave transceiver circuitry (e.g., circuitry that transmits and receives antennas signals at frequencies greater than 10 GHz). The antennas may be arranged in a phased antenna array. The phased antenna array may be controlled using phase and magnitude controllers. The phase and magnitude controllers may include amplifier circuitry within an integrated circuit.

The electronic device may include an antenna module. The antenna module may include a dielectric substrate. The dielectric substrate may include antenna layers and transmission line layers separated by a ground plane. The integrated circuit may be mounted to a surface of the transmission line layers. A radio-frequency connector may be mounted to the surface of the transmission line layers. The radio-frequency connector may couple the signal conductor of a transmission line to the integrated circuit over conductive traces in the transmission line layers. The phased antenna array may include antenna resonating elements on the antenna layers.

A passive resonator may be formed in the antenna layers. The passive resonator may include a conductive trace in the antenna layers that is coupled to the ground plane by a vertical conductive structure such as a fence of conductive vias, conductive tape, or other conductors. The passive resonator may resonate at one-quarter of the effective wavelength of operation of the phased antenna array to form an open circuit impedance for surface currents generated on the ground plane by the phased antenna array. This may serve to block the surface currents from scattering at an edge of the ground plane and leaking onto the integrated circuit.

DETAILED DESCRIPTION

Figure 1:
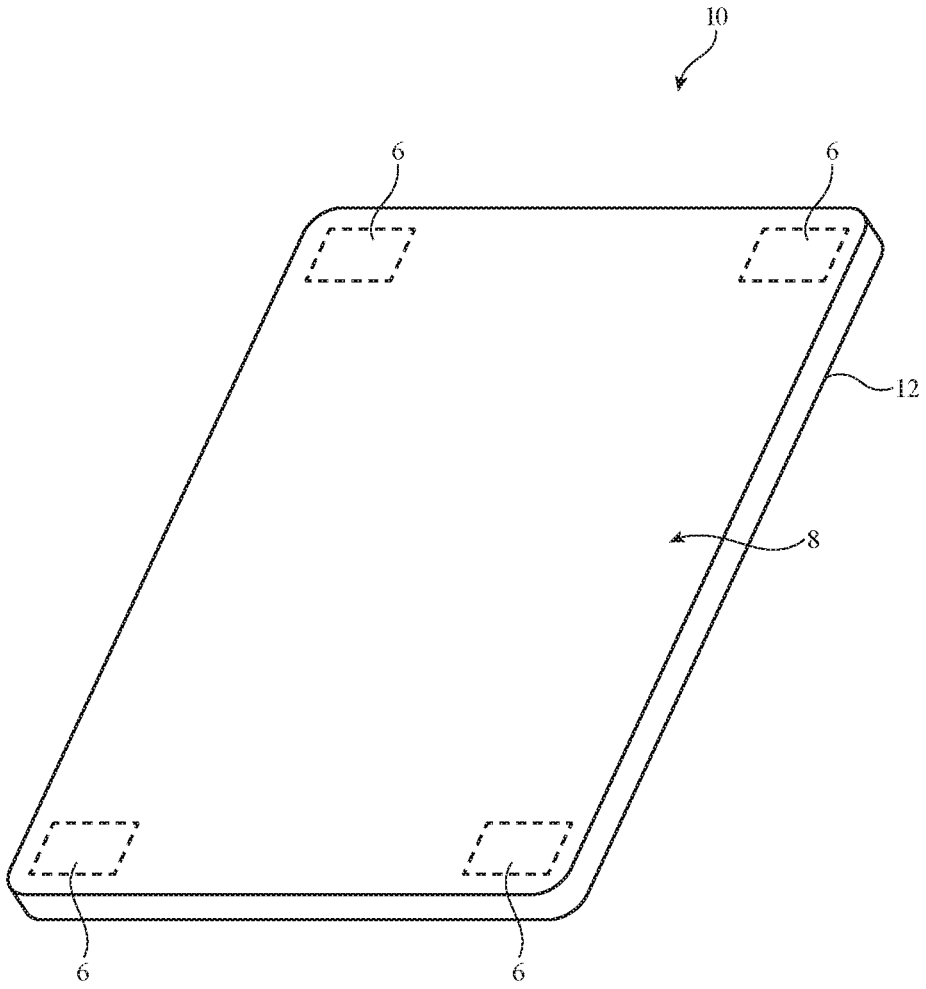
FIG. 1 is a perspective view of an illustrative electronic device with wireless circuitry in accordance with some embodiments.

An electronic device such as electronic device 10 of FIG. 1 may contain wireless circuitry. The wireless circuitry may include one or more antennas. The antennas may include phased antenna arrays that are used for handling millimeter wave and centimeter wave communications. Millimeter wave communications, which are sometimes referred to as extremely high frequency (EHF) communications, involve signals at 60 GHz or other frequencies between about 30 GHz and 300 GHz. Centimeter wave communications involve signals at frequencies between about 10 GHz and 30 GHz. The electronic device may include antennas for performing wireless communications using signals at these frequencies. If desired, device 10 may also contain wireless communications circuitry for handling satellite navigation system signals, cellular telephone signals, local wireless area network signals, near-field communications, light-based wireless communications, or other wireless communications.

Electronic device 10 may be a computing device such as a laptop computer, a computer monitor containing an embedded computer, a tablet computer, a cellular telephone, a media player, or other handheld or portable electronic device, a smaller device such as a wristwatch device, a pendant device, a headphone or earpiece device, a virtual or augmented reality headset device, a device embedded in eyeglasses or other equipment worn on a user's head, or other wearable or miniature device, a television, a computer display that does not contain an embedded computer, a gaming device, a navigation device, an embedded system such as a system in which electronic equipment with a display is mounted in a kiosk or automobile, a wireless access point or base station, a desktop computer, a keyboard, a gaming controller, a computer mouse, a mousepad, a trackpad or touchpad, equipment that implements the functionality of two or more of these devices, or other electronic equipment. In the illustrative configuration of FIG. 1, device 10 is a portable device such as a cellular telephone, media player, tablet computer, or other portable computing device. Other configurations may be used for device 10 if desired. The example of FIG. 1 is merely illustrative.

As shown in FIG. 1, device 10 may include a display such as display 8. Display 8 may be mounted in a housing such as housing 12. Housing 12, which may sometimes be referred to as an enclosure or case, may be formed of plastic, glass, ceramics, fiber composites, metal (e.g., stainless steel, aluminum, etc.), other suitable materials, or a combination of any two or more of these materials. Housing 12 may be formed using a unibody configuration in which some or all of housing 12 is machined or molded as a single structure or may be formed using multiple structures (e.g., an internal frame structure, one or more structures that form exterior housing surfaces, etc.).

Display 8 may be a touch screen display that incorporates a layer of conductive capacitive touch sensor electrodes or other touch sensor components (e.g., resistive touch sensor components, acoustic touch sensor components, force-based touch sensor components, light-based touch sensor components, etc.) or may be a display that is not touch-sensitive. Capacitive touch screen electrodes may be formed from an array of indium tin oxide pads or other transparent conductive structures.

Display 8 may include an array of display pixels formed from liquid crystal display (LCD) components, an array of electrophoretic display pixels, an array of plasma display pixels, an array of organic light-emitting diode display pixels, an array of electrowetting display pixels, or display pixels based on other display technologies.

Display 8 may be protected using a display cover layer such as a layer of transparent glass, clear plastic, sapphire, or other transparent dielectric. Openings may be formed in the display cover layer. For example, openings may be formed in the display cover layer to accommodate one or more buttons, sensor circuitry such as a fingerprint sensor or light sensor, ports such as a speaker port or microphone port, etc. Openings may be formed in housing 12 to form communications ports (e.g., an audio jack port, a digital data port, charging port, etc.). Openings in housing 12 may also be formed for audio components such as a speaker and/or a microphone.

Antennas may be mounted in housing 12. If desired, some of the antennas (e.g., antenna arrays that may implement beam steering, etc.) may be mounted under an inactive border region of display 8 (see, e.g., illustrative antenna locations 6 of FIG. 1). Display 8 may contain an active area with an array of pixels (e.g., a central rectangular portion). Inactive areas of display 8 are free of pixels and may form borders for the active area. If desired, antennas may also operate through dielectric-filled openings in the rear of housing 12 or elsewhere in device 10.

To avoid disrupting communications when an external object such as a human hand or other body part of a user blocks one or more antennas, antennas may be mounted at multiple locations in housing 12. Sensor data such as proximity sensor data, real-time antenna impedance measurements, signal quality measurements such as received signal strength information, and other data may be used in determining when one or more antennas is being adversely affected due to the orientation of housing 12, blockage by a user's hand or other external object, or other environmental factors. Device 10 can then switch one or more replacement antennas into use in place of the antennas that are being adversely affected.

Antennas may be mounted at the corners of housing 12 (e.g., in corner locations 6 of FIG. 1 and/or in corner locations on the rear of housing 12), along the peripheral edges of housing 12, on the rear of housing 12, under the display cover glass or other dielectric display cover layer that is used in covering and protecting display 8 on the front of device 10, under a dielectric window on a rear face of housing 12 or the edge of housing 12, or elsewhere in device 10.

Figure 2:
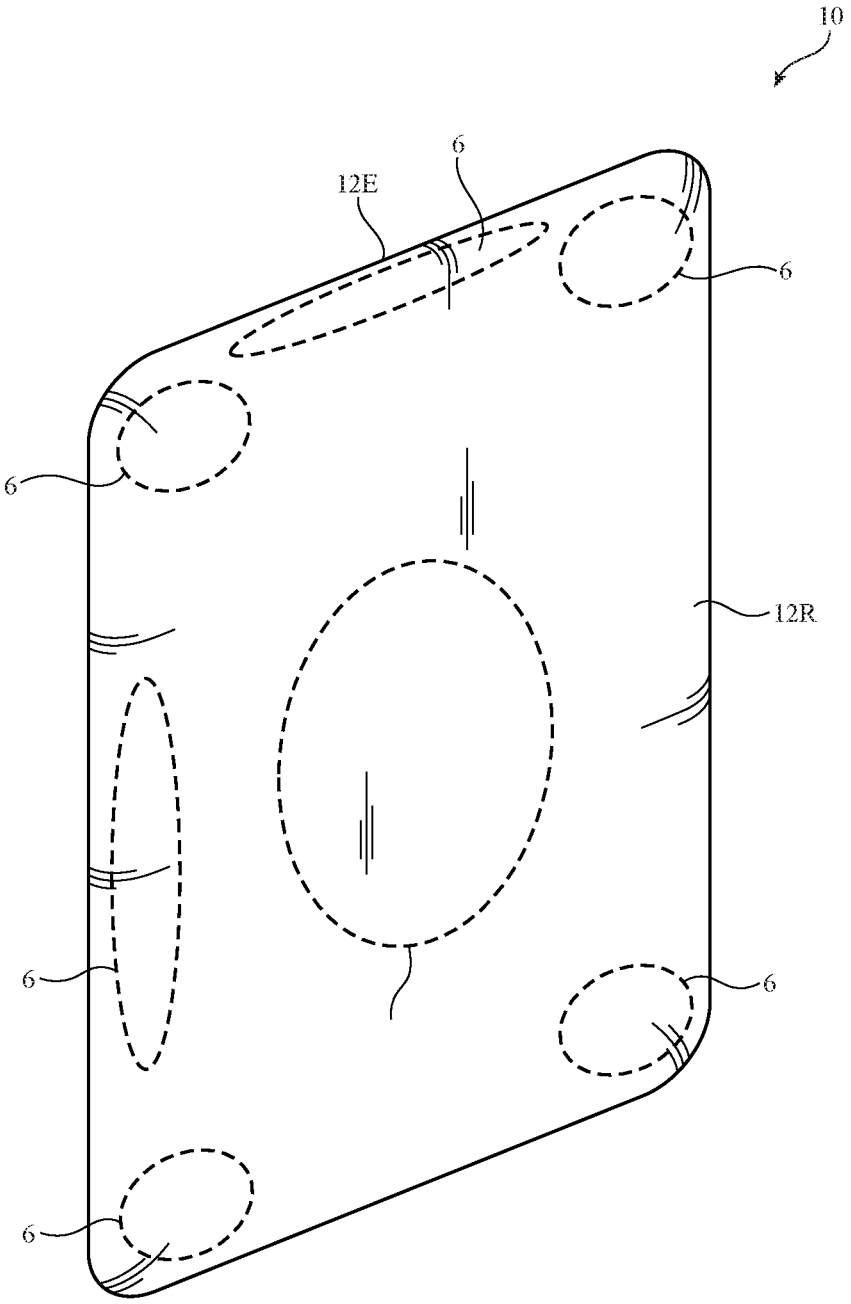
FIG. 2 is a rear perspective view of an illustrative electronic device in accordance with some embodiments.

FIG. 2 is a rear perspective view of electronic device 10 showing illustrative locations 6 on the rear and sides of housing 12 in which antennas (e.g., single antennas and/or phased antenna arrays) may be mounted in device 10. The antennas may be mounted at the corners of device 10, along the edges of housing 12 such as edges formed by sidewalls 12E, on upper and lower portions of rear housing portion (wall) 12R, in the center of rear housing wall 12R (e.g., under a dielectric window structure or other antenna window in the center of rear housing 12R), at the corners of rear housing wall 12R (e.g., on the upper left corner, upper right corner, lower left corner, and lower right corner of the rear of housing 12 and device 10), etc.

In configurations in which housing 12 is formed entirely or nearly entirely from a dielectric, the antennas may transmit and receive antenna signals through any suitable portion of the dielectric. In configurations in which housing 12 is formed from a conductive material such as metal, regions of the housing such as slots or other openings in the metal may be filled with plastic or other dielectric. The antennas may be mounted in alignment with the dielectric in the openings. These openings, which may sometimes be referred to as dielectric antenna windows, dielectric gaps, dielectric-filled openings, dielectric-filled slots, elongated dielectric opening regions, etc., may allow antenna signals to be transmitted to external wireless equipment from the antennas mounted within the interior of device 10 and may allow internal antennas to receive antenna signals from external wireless equipment. In another suitable arrangement, the antennas may be mounted on the exterior of conductive portions of housing 12.

Figure 3:
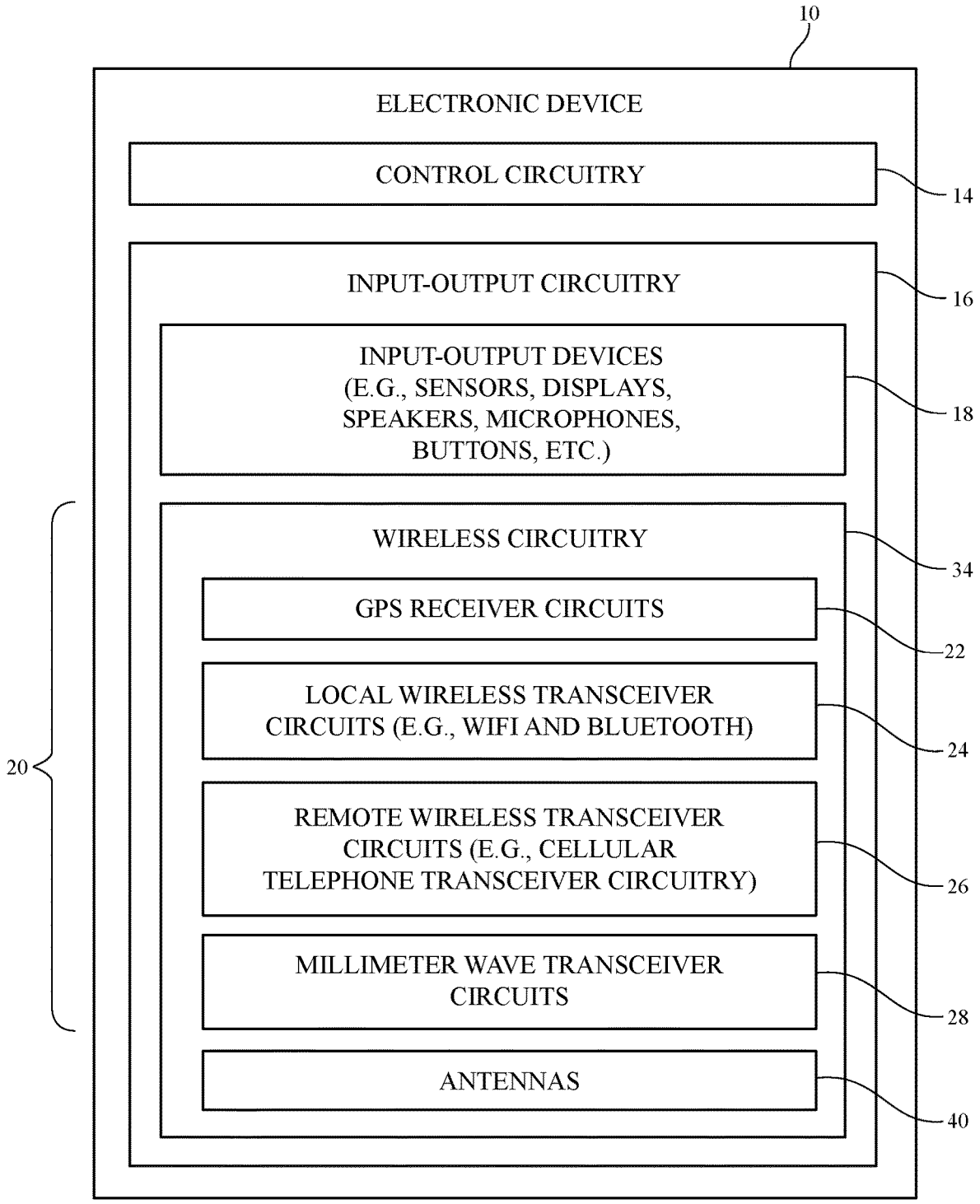
FIG. 3 is a schematic diagram of an illustrative electronic device with wireless circuitry in accordance with some embodiments.

A schematic diagram showing illustrative components that may be used in device 10 is shown in FIG. 3. As shown in FIG. 3, device 10 may include storage and processing circuitry such as control circuitry 14. Control circuitry 14 may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in control circuitry 14 may be used to control the operation of device 10. This processing circuitry may be based on one or more microprocessors, microcontrollers, digital signal processors, host processors, baseband processor integrated circuits, application specific integrated circuits, etc.

Control circuitry 14 may be used to run software on device 10 such as internet browsing applications, voice-over-internet-protocol (VOIP) telephone call applications, email applications, media playback applications, operating system functions, etc. To support interactions with external equipment, control circuitry 14 may be used in implementing communications protocols. Communications protocols that may be implemented using control circuitry 14 include internet protocols, wireless local area network protocols (e.g., IEEE 802.11 protocols—sometimes referred to as WiFi®), protocols for other short-range wireless communications links such as the Bluetooth® protocol or other WPAN protocols, IEEE 802.11 ad protocols, cellular telephone protocols, MIMO protocols, antenna diversity protocols, satellite navigation system protocols, antenna-based spatial ranging protocols (e.g., radio detection and ranging (RADAR) protocols or other desired range detection protocols for signals conveyed at millimeter and centimeter wave frequencies), etc. Each communication protocol may be associated with a corresponding radio access technology (RAT) that specifies the physical connection methodology used in implementing the protocol.

The control circuitry in device 10 (e.g., control circuitry 14) may be configured to perform operations in device 10 using hardware (e.g., dedicated hardware or circuitry), firmware, and/or software. Software code for performing operations in device 10 is stored on non-transitory computer readable storage media (e.g., tangible computer readable storage media) in control circuitry 14. The software code may sometimes be referred to as program instructions, software, data, instructions, or code. The non-transitory computer readable storage media may include non-volatile memory such as non-volatile random-access memory (NVRAM), one or more hard drives (e.g., magnetic drives or solid state drives), one or more removable flash drives or other removable media, etc. Software stored on the non-transitory computer readable storage media may be executed on the processing circuitry of control circuitry 14. The processing circuitry may include application-specific integrated circuits with processing circuitry, one or more microprocessors, a central processing unit (CPU) or other processing circuitry.

Device 10 may include input-output circuitry 16. Input-output circuitry 16 may include input-output devices 18. Input-output devices 18 may be used to allow data to be supplied to device 10 and to allow data to be provided from device 10 to external devices. Input-output devices 18 may include user interface devices, data port devices, sensors, and other input-output components. For example, input-output devices may include touch screens, displays without touch sensor capabilities, buttons, joysticks, scrolling wheels, touch pads, key pads, keyboards, microphones, cameras, speakers, status indicators, light sources, audio jacks and other audio port components, digital data port devices, light sensors, gyroscopes, accelerometers or other components that can detect motion and device orientation relative to the Earth, capacitance sensors, proximity sensors (e.g., a capacitive proximity sensor and/or an infrared proximity sensor), magnetic sensors, and other sensors and input-output components.

Input-output circuitry 16 may include wireless communications circuitry such as wireless circuitry 34 for communicating wirelessly with external equipment. Wireless circuitry 34 may include radio-frequency (RF) transceiver circuitry formed from one or more integrated circuits, power amplifier circuitry, low-noise input amplifiers, passive RF components, one or more antennas 40, transmission lines, and other circuitry for handling RF wireless signals. Wireless signals can also be sent using light (e.g., using infrared communications).

Wireless circuitry 34 may include transceiver circuitry 20 for handling various radio-frequency communications bands. For example, transceiver circuitry 20 may include Global Positioning System (GPS) receiver circuits 22, local wireless transceiver circuits 24, remote wireless transceiver circuits 26, and/or millimeter wave transceiver circuits 28.

Local wireless transceiver circuits 24 may include wireless local area network (WLAN) transceiver circuitry and may therefore sometimes be referred to herein as WLAN transceiver circuitry 24. WLAN transceiver circuitry 24 may handle 2.4 GHz and 5 GHz bands for WiFi® (IEEE 802.11) communications and may handle the 2.4 GHz Bluetooth® communications band.

Remote wireless transceiver circuits 26 may include cellular telephone transceiver circuitry and may therefore sometimes be referred to herein as cellular telephone transceiver circuitry 26. Cellular telephone transceiver circuitry 26 may handle wireless communications in frequency ranges such as a communications band from 700 to 960 MHz, a communications band from 1710 to 2170 MHz, and a communications band from 2300 to 2700 MHz or other communications bands between 600 MHz and 4000 MHz or other suitable frequencies (as examples). Cellular telephone transceiver circuitry 26 may handle voice data and non-voice data.

Millimeter wave transceiver circuits 28 (sometimes referred to herein as extremely high frequency (EHF) transceiver circuitry 28 or millimeter wave transceiver circuitry 28) may support communications at frequencies between about 10 GHz and 300 GHz. For example, millimeter wave transceiver circuitry 28 may support communications in Extremely High Frequency (EHF) or millimeter wave communications bands between about 30 GHz and 300 GHz and/or in centimeter wave communications bands between about 10 GHz and 30 GHz (sometimes referred to as Super High Frequency (SHF) bands). As examples, millimeter wave transceiver circuitry 28 may support communications in an IEEE K communications band between about 18 GHz and 27 GHz, a $K_a$ communications band between about 26.5 GHz and 40 GHz, a $K_u$ communications band between about 12 GHz and 18 GHz, a V communications band between about 40 GHz and 75 GHz, a W communications band between about 75 GHz and 110 GHz, or any other desired frequency band between approximately 10 GHz and 300 GHz. If desired, millimeter wave transceiver circuitry 28 may support IEEE 802.11 ad communications at 60 GHz and/or $5^{th}$ generation mobile networks or $5^{th}$ generation wireless systems (5G) communications bands between 27 GHz and 90 GHz. If desired, millimeter wave transceiver circuitry 28 may support communications at multiple frequency bands between 10 GHz and 300 GHz such as a first band from 27.5 GHz to 29.5 GHz, a second band from 37 GHz to 41 GHz, a third band from 57 GHz to 71 GHz, and/or other communications bands between 10 GHz and 300 GHz. Millimeter wave transceiver circuitry 28 may be formed from one or more integrated circuits (e.g., multiple integrated circuits mounted on a common printed circuit in a system-in-package device, one or more integrated circuits mounted on different substrates, etc.).

While circuitry 28 is sometimes referred to herein as millimeter wave transceiver circuitry 28, millimeter wave transceiver circuitry 28 may handle communications at any desired communications bands at frequencies between 10 GHz and 300 GHz (e.g., in millimeter wave communications bands, centimeter wave communications bands, etc.). If desired, millimeter wave transceiver circuitry 28 may include spatial ranging circuitry (e.g., millimeter wave spatial ranging circuitry) that performs spatial ranging operations using millimeter and/or centimeter wave signals transmitted and received by antennas 40. The spatial ranging circuitry may use the transmitted and received signals to detect or estimate a range between device 10 and external objects in the surroundings of device 10 (e.g., objects external to housing 12 and device 10 such as the body of the user or other persons, other devices, animals, furniture, walls, or other objects or obstacles in the vicinity of device 10).

GPS receiver circuits 22 may receive GPS signals at 1575 MHz or signals for handling other satellite positioning data (e.g., GLONASS signals at 1609 MHz). Satellite navigation system signals for GPS receiver circuits 22 are received from a constellation of satellites orbiting the earth.

Wireless circuitry 34 can include circuitry for other short-range and long-range wireless links if desired. For example, wireless circuitry 34 may include circuitry for receiving television and radio signals, paging system transceivers, near field communications (NFC) circuitry, etc.

In satellite navigation system links, cellular telephone links, and other long-range links, wireless signals are typically used to convey data over thousands of feet or miles. In WiFi® and Bluetooth® links at 2.4 and 5 GHz and other short-range wireless links, wireless signals are typically used to convey data over tens or hundreds of feet. Millimeter wave transceiver circuitry 28 may convey signals over short distances that travel between transmitter and receiver over a line-of-sight path. To enhance signal reception for millimeter and centimeter wave communications, phased antenna arrays and beam steering techniques may be used (e.g., schemes in which antenna signal phase and/or magnitude for each antenna in an array is adjusted to perform beam steering). Antenna diversity schemes may also be used to ensure that the antennas that have become blocked or that are otherwise degraded due to the operating environment of device 10 can be switched out of use and higher-performing antennas used in their place.

Antennas 40 in wireless circuitry 34 may be formed using any suitable antenna types. For example, antennas 40 may include antennas with resonating elements that are formed from stacked patch antenna structures, loop antenna structures, patch antenna structures, inverted-F antenna structures, slot antenna structures, planar inverted-F antenna structures, monopoles, dipoles, helical antenna structures, Yagi (Yagi-Uda) antenna structures, hybrids of these designs, etc. If desired, one or more of antennas 40 may be cavity-backed antennas. Different types of antennas may be used for different bands and combinations of bands. For example, one type of antenna may be used in forming a local wireless link antenna and another type of antenna may be used in forming a remote wireless link antenna. Dedicated antennas may be used for receiving satellite navigation system signals or, if desired, antennas 40 can be configured to receive both satellite navigation system signals and signals for other communications bands (e.g., wireless local area network signals and/or cellular telephone signals). Antennas 40 may include antennas arranged in one or more phased antenna arrays for handling millimeter and centimeter wave communications.

Transmission line paths may be used to route antenna signals within device 10. For example, transmission line paths may be used to couple antennas 40 to transceiver circuitry 20. Transmission line paths in device 10 (sometimes referred to herein as transmission lines) may include coaxial cables, coaxial probes realized by metalized vias, microstrip transmission lines, stripline transmission lines, edge-coupled microstrip transmission lines, edge-coupled stripline transmission lines, waveguide structures, transmission lines formed from combinations of transmission lines of these types, etc.

If desired, transmission lines in device 10 may be integrated into rigid and/or flexible printed circuit boards. In one suitable arrangement, transmission lines in device 10 may also include transmission line conductors (e.g., signal and ground conductors) integrated within multilayer laminated structures (e.g., layers of a conductive material such as copper and a dielectric material such as a resin that are laminated together without intervening adhesive) that may be folded or bent in multiple dimensions (e.g., two or three dimensions) and that maintain a bent or folded shape after bending (e.g., the multilayer laminated structures may be folded into a particular three-dimensional shape to route around other device components and may be rigid enough to hold its shape after folding without being held in place by stiffeners or other structures). All of the multiple layers of the laminated structures may be batch laminated together (e.g., in a single pressing process) without adhesive (e.g., as opposed to performing multiple pressing processes to laminate multiple layers together with adhesive). Filter circuitry, switching circuitry, impedance matching circuitry, and other circuitry may be interposed within the transmission lines, if desired.

In devices such as handheld devices, the presence of an external object such as the hand of a user or a table or other surface on which a device is resting has a potential to block wireless signals such as millimeter wave signals. Accordingly, it may be desirable to incorporate multiple antennas or phased antenna arrays into device 10, each of which is placed at a different location within device 10. With this type of arrangement, an unblocked antenna or phased antenna array may be switched into use. In scenarios where a phased antenna array is formed in device 10, once switched into use, the phased antenna array may use beam steering to optimize wireless performance. Configurations in which antennas from one or more different locations in device 10 are operated together may also be used.

In devices with phased antenna arrays, wireless circuitry 34 may include gain and phase adjustment circuitry that is used in adjusting the signals associated with each antenna 40 in the phased antenna array (e.g., to perform beam steering to point a signal beam of the phased antenna array in a desired pointing direction). Switching circuitry may be used to switch desired antennas 40 into and out of use. If desired, each of locations 6 of FIGS. 1 and 2 may include multiple antennas 40 (e.g., a set of three antennas or more than three or fewer than three antennas in a phased antenna array) and, if desired, one or more antennas from one of locations 6 may be used in transmitting and receiving signals while using one or more antennas from another of locations 6 in transmitting and receiving signals.

Figure 4:
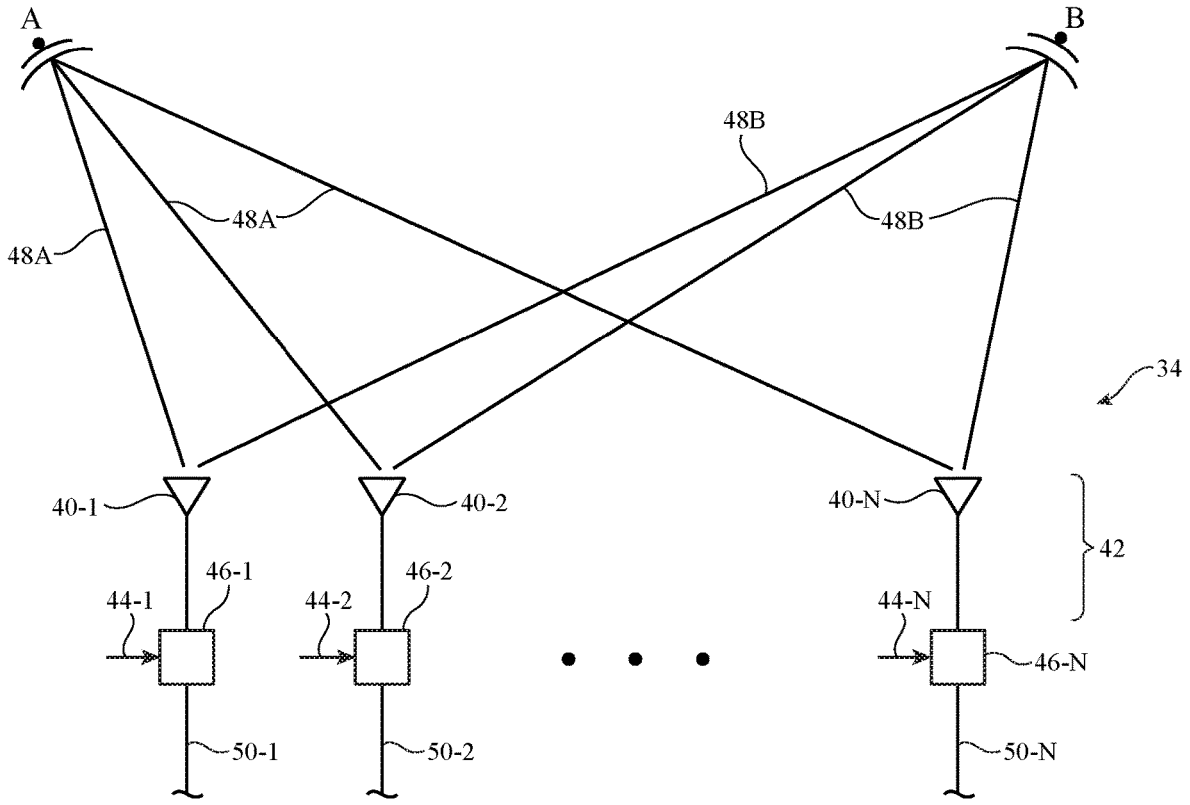
FIG. 4 is a diagram of an illustrative phased antenna array that may be adjusted using control circuitry to direct a beam of signals in accordance with some embodiments.

FIG. 4 shows how antennas 40 for handling millimeter and centimeter wave communications may be formed in a phased antenna array. As shown in FIG. 4, phased antenna array 42 (sometimes referred to herein as array 42, antenna array 42, or array 42 of antennas 40) may be coupled to signal paths such as transmission line paths 50 (e.g., one or more radio-frequency transmission lines). For example, a first antenna 40-1 in phased antenna array 42 may be coupled to a first transmission line path 50-1, a second antenna 50-2 in phased antenna array 42 may be coupled to a second transmission line path 50-2, an Nth antenna 40-N in phased antenna array 42 may be coupled to an Nth transmission line path 50-N, etc. While antennas 40 are described herein as forming a phased antenna array, the antennas 40 in phased antenna array 42 may sometimes be referred to as collectively forming a single phased array antenna.

Antennas 40 in phased antenna array 42 may be arranged in any desired number of rows and columns or in any other desired pattern (e.g., the antennas need not be arranged in a grid pattern having rows and columns). During signal transmission operations, transmission line paths 50 may be used to supply signals (e.g., radio-frequency signals such as millimeter wave and/or centimeter wave signals) from millimeter wave transceiver circuitry 28 (FIG. 3) to phased antenna array 42 for wireless transmission to external wireless equipment. During signal reception operations, transmission line paths 50 may be used to convey signals received at phased antenna array 42 from external wireless equipment to millimeter wave transceiver circuitry 28 (FIG. 3).

The use of multiple antennas 40 in phased antenna array 42 allows beam steering arrangements to be implemented by controlling the relative phases and magnitudes (amplitudes) of the radio-frequency signals conveyed by the antennas. In the example of FIG. 4, antennas 40 each have a corresponding radio-frequency phase and magnitude controller 46 (e.g., a first phase and magnitude controller 46-1 interposed on transmission line path 50-1 may control phase and magnitude for radio-frequency signals handled by antenna 40-1, a second phase and magnitude controller 46-2 interposed on transmission line path 50-2 may control phase and magnitude for radio-frequency signals handled by antenna 40-2, an Nth phase and magnitude controller 46-N interposed on transmission line path 50-N may control phase and magnitude for radio-frequency signals handled by antenna 40-N, etc.).

Phase and magnitude controllers 46 may each include circuitry for adjusting the phase of the radio-frequency signals on transmission line paths 50 (e.g., phase shifter circuits) and/or circuitry for adjusting the magnitude of the radio-frequency signals on transmission line paths 50 (e.g., power amplifier and/or low noise amplifier circuits). Phase and magnitude controllers 46 may sometimes be referred to collectively herein as beam steering circuitry (e.g., beam steering circuitry that steers the beam of radio-frequency signals transmitted and/or received by phased antenna array 42).

Phase and magnitude controllers 46 may adjust the relative phases and/or magnitudes of the transmitted signals that are provided to each of the antennas in phased antenna array 42 and may adjust the relative phases and/or magnitudes of the received signals that are received by phased antenna array 42 from external wireless equipment. Phase and magnitude controllers 46 may, if desired, include phase detection circuitry for detecting the phases of the received signals that are received by phased antenna array 42 from external wireless equipment. The term "beam" or "signal beam" may be used herein to collectively refer to wireless signals that are transmitted and received by phased antenna array 42 in a particular direction. The signal beam may exhibit a peak gain that is oriented in a particular pointing direction at a corresponding pointing angle (e.g., based on constructive and destructive interference from the combination of signals from each antenna in the phased antenna array). The term "transmit beam" may sometimes be used herein to refer to radio-frequency signals that are transmitted in a particular direction whereas the term "receive beam" may sometimes be used herein to refer to radio-frequency signals that are received from a particular direction.

If, for example, phase and magnitude controllers 46 are adjusted to produce a first set of phases and/or magnitudes for transmitted millimeter wave signals, the transmitted signals will form a millimeter wave frequency transmit beam as shown by beam 48A of FIG. 4 that is oriented in the direction of point A. If, however, phase and magnitude controllers 46 are adjusted to produce a second set of phases and/or magnitudes for the transmitted millimeter wave signals, the transmitted signals will form a millimeter wave frequency transmit beam as shown by beam 48B that is oriented in the direction of point B. Similarly, if phase and magnitude controllers 46 are adjusted to produce the first set of phases and/or magnitudes, wireless signals (e.g., millimeter wave signals in a millimeter wave frequency receive beam) may be received from the direction of point A as shown by beam 48A. If phase and magnitude controllers 46 are adjusted to produce the second set of phases and/or magnitudes, signals may be received from the direction of point B, as shown by beam 48B.

Each phase and magnitude controller 46 may be controlled to produce a desired phase and/or magnitude based on a corresponding control signal 44 received from control circuitry 14 of FIG. 3 or other control circuitry in device 10 (e.g., the phase and/or magnitude provided by phase and magnitude controller 46-1 may be controlled using control signal 44-1, the phase and/or magnitude provided by phase and magnitude controller 46-2 may be controlled using control signal 44-2, etc.). If desired, control circuitry 14 may actively adjust control signals 44 in real time to steer the transmit or receive beam in different desired directions over time. Phase and magnitude controllers 46 may provide information identifying the phase of received signals to control circuitry 14 if desired.

When performing millimeter or centimeter wave communications, radio-frequency signals are conveyed over a line of sight path between phased antenna array 42 and external wireless equipment. If the external wireless equipment is located at point A of FIG. 4, phase and magnitude controllers 46 may be adjusted to steer the signal beam towards point A (e.g., to steer the pointing direction of the signal beam towards point A). If the external equipment is located at location B, phase and magnitude controllers 46 may be adjusted to steer the signal beam towards direction B. In the example of FIG. 4, beam steering is shown as being performed over a single degree of freedom for the sake of simplicity (e.g., towards the left and right on the page of FIG. 4). However, in practice, the beam is steered over two or more degrees of freedom (e.g., in three dimensions, into and out of the page and to the left and right on the page of FIG. 4).

Figure 5:
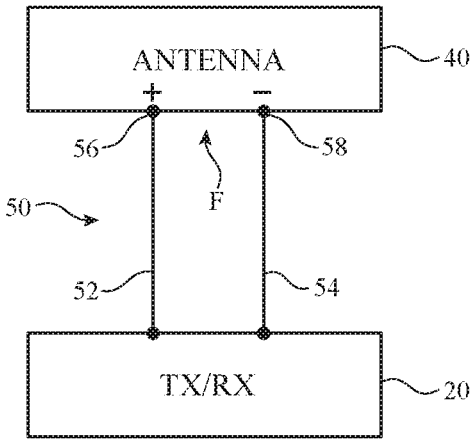
FIG. 5 is a diagram of an illustrative transceiver circuit and antenna in accordance with some embodiments.

A schematic diagram of an antenna 40 that may be formed in phased antenna array 42 (e.g., as antenna 40-1, 40-2, 40-3, and/or 40-N in phased antenna array 42 of FIG. 4) is shown in FIG. 5. As shown in FIG. 5, antenna 40 may be coupled to transceiver circuitry 20 (e.g., millimeter wave transceiver circuitry 28 of FIG. 3). Transceiver circuitry 20 may be coupled to antenna feed F of antenna 40 using transmission line path 50 (sometimes referred to herein as radio-frequency transmission line 50). Antenna feed F may include a positive antenna feed terminal such as positive antenna feed terminal 56 and may include a ground antenna feed terminal such as ground antenna feed terminal 58. Transmission line path 50 may include a positive signal conductor such as signal conductor 52 that is coupled to terminal 56 and a ground conductor such as ground conductor 54 that is coupled to terminal 58.

Any desired antenna structures may be used for implementing antenna 40. In one suitable arrangement that is sometimes described herein as an example, patch antenna structures may be used for implementing antenna 40. Antennas 40 that are implemented using patch antenna structures may sometimes be referred to herein as patch antennas. An illustrative patch antenna that may be used in phased antenna array 42 of FIG. 4 is shown in FIG. 6.

Figure 6:
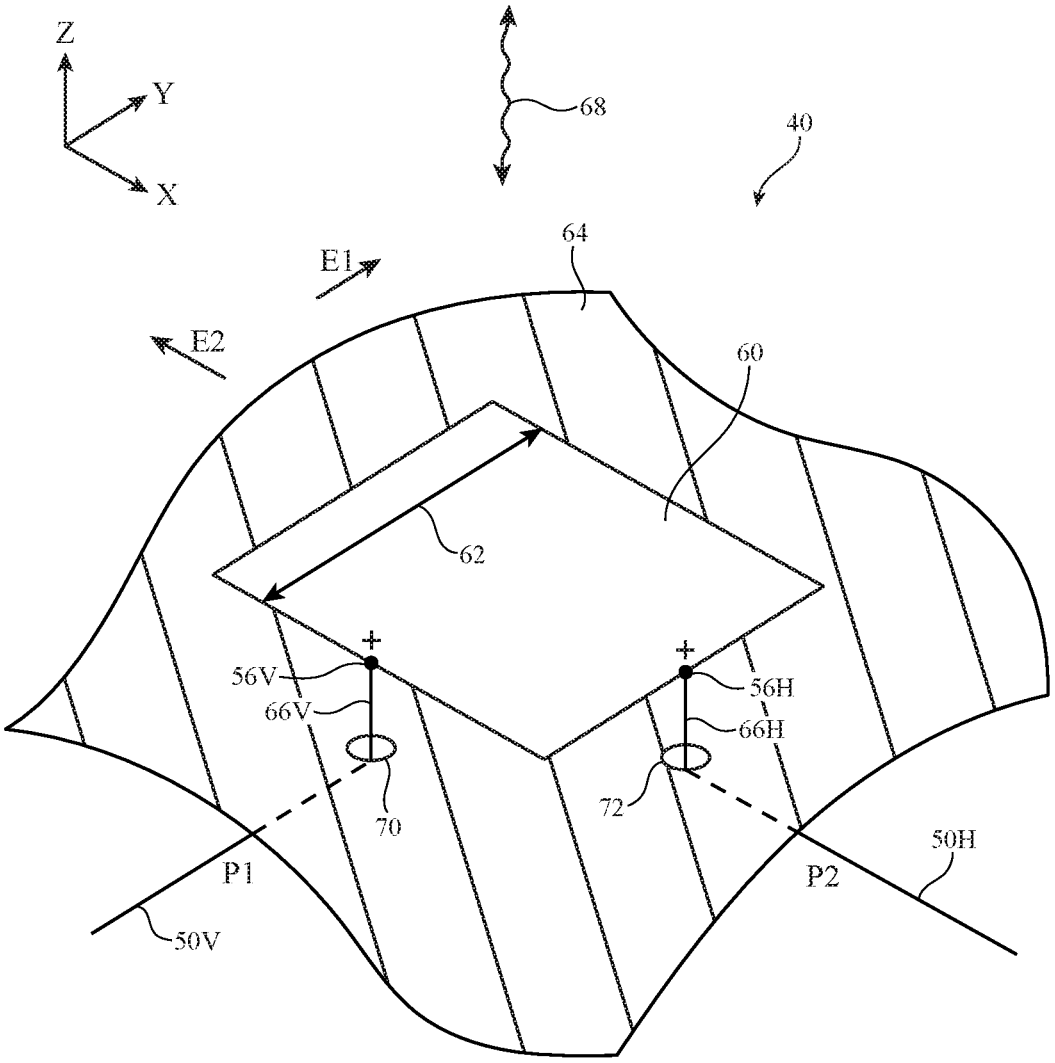
FIG. 6 is a perspective view of an illustrative patch antenna with dual ports in accordance with some embodiments.

As shown in FIG. 6, antenna 40 may have a patch antenna resonating element 60 that is separated from and parallel to a ground plane such as antenna ground plane 64 (sometimes referred to herein as antenna ground 64). Patch antenna resonating element 60 may lie within a plane such as the X-Y plane of FIG. 6 (e.g., the lateral surface area of element 60 may lie in the X-Y plane). Patch antenna resonating element 60 may sometimes be referred to herein as patch 60, patch element 60, patch resonating element 60, antenna resonating element 60, or resonating element 60. Antenna ground 64 may lie within a plane that is parallel to the plane of patch element 60. Patch element 60 and antenna ground 64 may therefore lie in separate parallel planes that are separated by a fixed distance. Patch element 60 and antenna ground 64 may be formed from conductive traces patterned on a dielectric substrate such as a rigid or flexible printed circuit board substrate, metal foil, stamped sheet metal, electronic device housing structures, or any other desired conductive structures.

The length of the sides of patch element 60 may be selected so that antenna 40 resonates (radiates) at a desired operating frequency. For example, the sides of patch element 60 may each have a length 62 that is approximately equal to half of the wavelength of the signals conveyed by antenna 40 (e.g., the effective wavelength given the dielectric properties of the materials surrounding patch element 60). In one suitable arrangement, length 62 may be between 0.8 mm and 1.2 mm (e.g., approximately 1.1 mm) for covering a millimeter wave frequency band between 57 GHz and 70 GHz, as just one example.

The example of FIG. 6 is merely illustrative. Patch element 60 may have a square shape in which all of the sides of patch element 60 are the same length or may have a different rectangular shape. Patch element 60 may be formed in other shapes having any desired number of straight and/or curved edges. If desired, patch element 60 and antenna ground 64 may have different shapes and relative orientations.

To enhance the polarizations handled by antenna 40, antenna 40 may be provided with multiple feeds. As shown in FIG. 6, antenna 40 may have a first feed at antenna port P1 that is coupled to a first transmission line path 50 such as transmission line path 50V and a second feed at antenna port P2 that is coupled to a second transmission line path 50 such as transmission line path 50H. The first antenna feed may have a first ground antenna feed terminal coupled to antenna ground 64 (not shown in FIG. 6 for the sake of clarity) and a first positive antenna feed terminal 56 such as positive antenna feed terminal 56V coupled to patch element 60. The second antenna feed may have a second ground antenna feed terminal coupled to antenna ground 64 (not shown in FIG. 6 for the sake of clarity) and a second positive antenna feed terminal 56 such as positive antenna feed terminal 56H coupled to patch element 60.

Holes or openings such as openings 70 and 72 may be formed in antenna ground 64. Transmission line path 50V may include a vertical conductor 66V (e.g., a conductive through-via, conductive pin, metal pillar, solder bump, combinations of these, or other vertical conductive interconnect structures) that extends through hole 70 to positive antenna feed terminal 56V on patch element 60. Transmission line path 50H may include a vertical conductor 66H that extends through hole 72 to positive antenna feed terminal 56H on patch element 60. This example is merely illustrative and, if desired, other transmission line structures may be used (e.g., coaxial cable structures, stripline transmission line structures, etc.).

When using the first antenna feed associated with port P1, antenna 40 may transmit and/or receive radio-frequency signals having a first linear polarization (e.g., the electric field E1 of antenna signals 68 associated with port P1 may be oriented parallel to the Y-axis in FIG. 6). When using the antenna feed associated with port P2, antenna 40 may transmit and/or receive radio-frequency signals having a second linear polarization (e.g., the electric field E2 of antenna signals 68 associated with port P2 may be oriented parallel to the X-axis of FIG. 6 so that the linear polarizations associated with ports P1 and P2 are orthogonal to each other).

One of ports P1 and P2 may be used at a given time so that antenna 40 operates as a single-polarization antenna or both ports may be operated at the same time so that antenna 40 operates with other polarizations (e.g., as a dual-polarization antenna, a circularly-polarized antenna, an elliptically-polarized antenna, etc.). If desired, the active port may be changed over time so that antenna 40 can switch between covering vertical or horizontal polarizations at a given time. Ports P1 and P2 may be coupled to different phase and magnitude controllers or may both be coupled to the same phase and magnitude controller (e.g., in scenarios where antenna 40 is formed within a phased antenna array). If desired, ports P1 and P2 may both be operated with the same phase and magnitude at a given time (e.g., when antenna 40 acts as a dual-polarization antenna). If desired, the phases and magnitudes of the radio-frequency signals conveyed over ports P1 and P2 may be controlled separately and varied over time so that antenna 40 exhibits other polarizations (e.g., circular or elliptical polarizations).

If care is not taken, antennas 40 such as dual-polarization patch antennas of the type shown in FIG. 6 may have insufficient bandwidth for covering an entirety of a communications band of interest (e.g., a communications band at frequencies greater than 10 GHz). If desired, antenna 40 may include one or more parasitic antenna resonating elements that serve to broaden the bandwidth of antenna 40 (e.g., to extend the bandwidth of antenna 40 to cover an entirety of a corresponding communications band). The parasitic antenna resonating elements may include one or more conductive patches located above patch element 60, as an example. The length of the parasitic antenna resonating element may be greater than or less than the length of patch element 60 to add additional resonances that broaden the bandwidth of the antenna. The parasitic antenna resonating element may have a cross shape for impedance matching if desired. Antenna 40 may be fed using a single antenna feed if desired. In another suitable arrangement, additional patch antennas (e.g., patch antennas having one or two antenna feeds) may be stacked over and/or under antenna 40 of FIG. 6. The patch elements in the stacked patch antennas may at least partially overlap.

The antenna structures shown in FIG. 6 are merely illustrative and, in general, any desired types of antennas may be used in phased antenna array 42 of FIG. 4. If desired, phased antenna array 42 may be integrated with other circuitry such as a radio-frequency integrated circuit to form an integrated antenna module.

Figure 7:
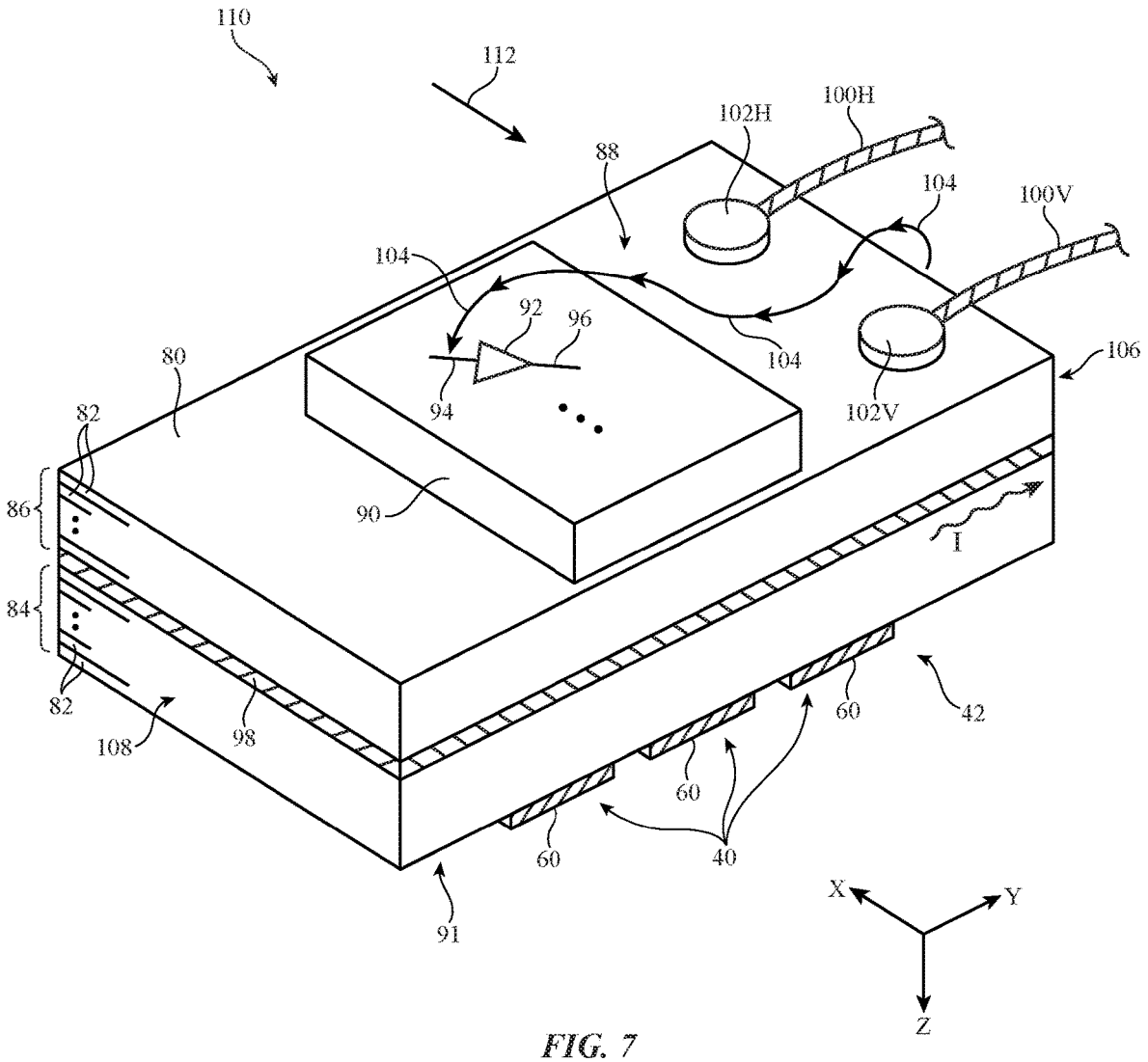
FIG. 7 is a perspective view of an illustrative antenna module in accordance with some embodiments.

FIG. 7 is a rear perspective view of an illustrative integrated antenna module for handling signals at frequencies greater than 10 GHz in device 10. As shown in FIG. 7, device 10 may be provided with an integrated antenna module such as integrated antenna module 110 (sometimes referred to herein as antenna module 110 or module 110). Module 110 may include phased antenna array 42 of antennas 40 formed on a dielectric substrate such as dielectric substrate 80. Substrate 80 may be, for example, a rigid or printed circuit board or other dielectric substrate. Substrate 80 may be a stacked dielectric substrate that includes multiple stacked dielectric layers 82 (e.g., multiple layers of printed circuit board substrate such as multiple layers of fiberglass-filled epoxy, rigid printed circuit board material, flexible printed circuit board material, ceramic, plastic, glass, or other dielectrics). Phased antenna array 42 may include any desired number of antennas 40 arranged in any desired pattern.

Antennas 40 in phased antenna array 42 may include elements such as patch elements 60, ground traces 98 (e.g., conductive traces forming antenna ground 64 of FIG. 6 for each of the antennas 40 in phased antenna array 42), and/or other components such as parasitic elements that are interposed between or formed on dielectric layers 82 of substrate 80. Patch elements 60 may be formed on surface 91 of substrate 80 or may be embedded within layers 82 at or adjacent to surface 91. Patch elements 60, parasitic elements in antennas 40, ground traces 98 may be formed from conductive traces on the dielectric layers 82 of substrate 80 (e.g., embedded within and/or on substrate 80).

One or more electrical components 90 may be mounted on surface 88 of substrate 80 (e.g., the surface of substrate 80 opposite surface 90 and patch elements 60). Component 90 may, for example, include an integrated circuit (e.g., an integrated circuit chip) or other circuitry mounted to surface 88 of substrate 80. Component 90 may include radio-frequency components such as amplifier circuitry 92, phase shifter circuitry, and other circuitry that operates on radio-frequency signals. Component 90 may sometimes be referred to herein as radio-frequency integrated circuit (RFIC) 90. However, this is merely illustrative and, in general, the circuitry of component 90 need not be formed on an integrated circuit. Amplifier circuitry 92 and phase shifter circuitry in RFIC 90 may, for example, form the phase and magnitude controllers 46 (FIG. 4) for phased antenna array 42. RFIC 90 may include ports coupled to the antenna feeds of the antennas 40 in phased antenna array 42.

Module 110 may receive radio-frequency signals from millimeter wave transceiver circuitry 28 (FIG. 3) over transmission line structures such as transmission lines 100H and 100V. Transmission lines 100H and 100V may be coaxial cables or any other desired transmission line structures and may form part of the transmission line paths 50 (FIG. 4) for phased antenna array 42. Transmission line 100H may have a first end coupled to millimeter wave transceiver circuitry 28 (FIG. 3) and a second end coupled to radio-frequency connector 102H on surface 88 of substrate 80 (e.g., connector 102H may receive transmission line 100H). Transmission line 100V may have a first end coupled to millimeter wave transceiver circuitry 28 (FIG. 3) and a second end coupled to radio-frequency connector 102V on surface 88 of substrate 80. Radio-frequency connectors 102H and 102V may include grounding structures that couple the ground conductors from transmission lines 100V and 100H to ground traces 98 (e.g., over conductive through-vias or other structures). Radio-frequency connectors 102H and 102V may couple the signal conductors from transmission lines 100V and 100H to RFIC 90 (e.g., using conductive traces and/or conductive vias on and/or in substrate 80). Transmission line 100V may be used to convey radio-frequency signals for antenna feed terminals 56V (FIG. 6) in the antennas 40 of phased antenna array 42. Transmission line 100H may be used to convey first radio-frequency signals for antenna feed terminals 56H (FIG. 6) in the antennas 40 of phased antenna array 42.

The dielectric layers 82 in substrate 80 may include a first set of layers 84 (sometimes referred to herein as antenna layers 84) and a second set of layers 86 (sometimes referred to herein as transmission line layers 86). Ground traces 98 may separate antenna layers 84 from transmission line layers 86. Conductive traces or other metal layers on transmission line layers 86 of substrate 80 may be used in forming transmission line structures such as transmission line paths 50 of FIG. 4. For example, conductive traces on transmission line layers 86 may be used in forming stripline or microstrip transmission lines that are coupled between the antenna feeds for antennas 40 (e.g., over conductive vias extending through antenna layers 84) and RFIC 90 (e.g., over conductive vias extending through transmission line layers 86). Conductive traces on transmission line layers 86 may also be used to couple radio-frequency connectors 102H and 102V and thus the signal conductors from transmission lines 100H and 100V to RFIC 90.

Radio-frequency connectors 102H and 102V and transmission lines 100H and 100V may be coupled to surface 88 at side (end) 106 of substrate 80. The presence of radio-frequency connectors 102H and 102V and the conductive traces in transmission line layers 86 that are used to couple connectors 102H and 102V to RFIC 90 may leave side 106 of module 110 susceptible to current leakage from antenna layers 84 of module 110. For example, the antennas 40 in phased antenna array 42 may generate surface current I that propagates laterally outwards along the surface of ground traces 98 (e.g., at the surface of ground traces 98 facing antenna layers 84). If care is not taken, current I may scatter at the edge of ground traces 98 at side 106 of module 110, through radio-frequency connectors 102H and 102V (e.g., through openings in connectors 102H and 102V that allow mechanical connections for transmission lines 100H and 100V but that form undesirable paths for ground current), and conductive traces in transmission line layers 86 onto RFIC 90 (as shown by arrows 104). This scattered current may further leak from output 96 onto input 94 of amplifier circuitry 92. This may allow signal noise to build up in a feedback loop at amplifier circuitry 92, generating undesirable oscillation in the response of amplifier circuitry 92 and ultimately serving to deteriorate the response of the antennas 40 in module 110.

Figure 8:
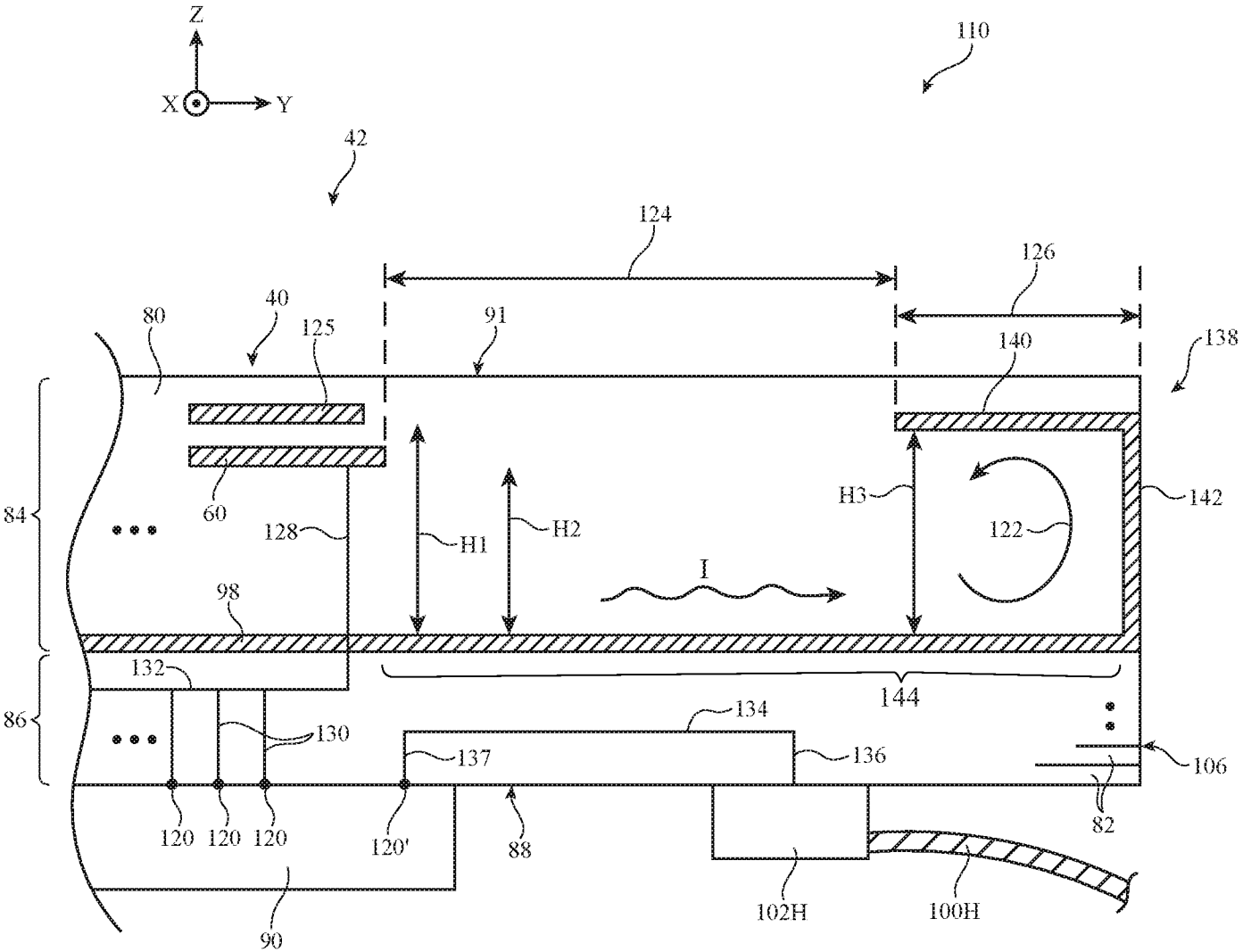
FIG. 8 is a cross-sectional side view of an illustrative antenna module having a passive resonator isolation element in accordance with some embodiments.

In order to mitigate these effects, an electromagnetic isolation element such as a passive resonator may be formed on or within antenna layers 84 at side 106 of module 110. FIG. 8 is a cross-sectional side view of module 110 (e.g., as taken in the direction of arrow 112 of FIG. 7) showing how module 110 may include a passive resonator for isolating RFIC 90 from surface current I.

As shown in FIG. 8, a given antenna 40 in phased antenna array 42 may include a corresponding patch element 60 embedded within antenna layers 84 of substrate 80. The antenna 40 shown in FIG. 8 may, for example, be the antenna in phased antenna array 42 that is located closest to side 106 of module 110. In the example of FIG. 8, antenna 40 is provided with a parasitic element 125 that serves to broaden the frequency response of antenna 40. Parasitic element 125 may be omitted if desired. Parasitic element 125 (or patch element 60 in scenarios where parasitic element 125 is omitted) may be formed on surface 91 of substrate 80 or may be embedded within substrate 80 (e.g., such that one or more dielectric layers 82 are formed over parasitic element 125).

RFIC 90 and radio-frequency connector 102H may be mounted to surface 88 of transmission line layers 86 in substrate 80. Radio-frequency transmission line 100H may be coupled to connector 102H. Connector 102V and transmission line 100V of FIG. 7 are omitted from FIG. 8 for the sake of clarity. The signal conductor from transmission line 100H may be coupled to conductive trace 134 through connector 102H and vertical conductive via 136 extending through transmission line layers 86. Conductive trace 134 may be coupled to radio-frequency port 120' on RFIC 90 over vertical conductive via 137 extending through transmission line layers 86. In another suitable arrangement, conductive trace 134 may be formed on surface 88 of substrate 80 and conductive vias 136 and 137 may be omitted. Radio-frequency connector 102H may include grounding structures that couple the ground conductor of transmission line 100H to ground in module 110 over conductive traces and/or conductive vias (not shown in FIG. 8 for the sake of clarity).

RFIC 90 may also include radio-frequency ports 120. Each radio-frequency port 120 may be coupled to a respective antenna 40 in phased antenna array 42 over a respective transmission line path (e.g., portions of transmission line paths 50 of FIG. 4). Ports 120 and 120' may include conductive contact pads, solder balls, microbumps, conductive pins, conductive pillars, conductive sockets, conductive clips, welds, conductive adhesive, conductive wires, interface circuits, or any other desired conductive interconnect structures.

Portions of the transmission line paths for antennas 40 may be embedded within transmission line layers 86. For example, the transmission line paths may include conductive traces 132 in transmission line layers 86 (e.g., conductive traces on a given dielectric layer 82 within transmission line layers 86). Conductive traces 132 may form part of the signal conductors (e.g., signal conductor 52 of FIG. 5) for the antennas 40 in phased antenna array 42. Ground traces 98 may form part of the ground conductors (e.g., ground conductor 54 of FIG. 5) for the antennas 40 in phased antenna array 42. If desired, additional grounded traces within transmission line layers 86 may be used to form part of the ground conductors for the transmission line paths.

Conductive traces 132 may be coupled to the positive antenna feed terminals of antennas 40 (e.g., positive antenna feed terminals 56V and 56H of FIG. 6) over vertical conductive vias 128. Conductive trace 134 may be formed on the same dielectric layer 82 as conductive traces 132 or conductive traces 132 and 134 may be formed on separate dielectric layers 82. Conductive traces 132 may be coupled to transceiver ports 120 over vertical conductive vias 130. Vertical conductive vias 128 may extend through transmission line layers 86, a hole or opening in ground traces 98, and antenna layers 84 to the patch elements 60 in phased antenna array 42. Vertical conductive vias 130 may extend through transmission line layers 86.

In the example of FIG. 8, antenna 40 is shown as having a single antenna feed coupled to a single vertical conductive via 128 for the sake of clarity and, if desired, each antenna 40 may include two antenna feeds (e.g., antenna feeds associated with positive antenna feed terminals 56V and 56H of FIG. 6) that are each coupled to a corresponding conductive via 128, conductive trace 132, conductive via 130, and port 120. In this way, conductive vias 128, 137, and 136, conductive traces 132 and 134, and the signal conductor of transmission line 100H may collectively form the signal conductor 52 (FIG. 5) for the antennas 40 in phased antenna array 42 (e.g., conductive vias conductive vias 128, 137, and 136, conductive traces 132 and 134, and the signal conductor of transmission line 100H may each form part of the transmission line path 50 for each antenna 40, as shown in FIG. 5).

As shown in FIG. 8, module 110 may include an electromagnetic isolation element such as passive resonator 138. Passive resonator 138 is a passive resonating element that is not directly fed using antenna signals or an antenna feed. Passive resonator 138 may be coupled to an extended portion 144 of ground traces 98 (e.g., a portion of ground traces 98 extending beyond the lateral outline of phased antenna array 42) and may include vertical conductive structure 142 extending through one or more dielectric layers 82 in antenna layers 84 and arm 140. Arm 140 may be formed from a conductive trace embedded within antenna layers 84 (e.g., on a corresponding dielectric layer 82) or formed on surface 91 of antenna layers 84. Arm 140 may be shorted to ground traces 98 (e.g., portion 144 of ground traces 98) over vertical conductive structure 142. Vertical conductive structure 142 may include conductive traces on side 106 of substrate 80, sheet metal over side 106 of substrate 80, conductive tape over side 106 of substrate 80, and/or vertical conductive vias extending through antenna layers 84, as examples. Vertical conductive structure 142 may sometimes be referred to herein as wall 142, sidewall 142, or leg 142. Arm 140 may sometimes be referred to herein as lip 140 or conductive trace 140.

Patch element 60 may be located at height H2 over ground traces 98. Parasitic element 125 may be located at height H1 over ground traces 98. Arm 140 of passive resonator 138 may be located at height H3 over ground traces 98 (e.g., vertical conductive structure 142 may have a length equal to height H3). Height H3 may be greater than or equal to height H1 or may be greater than or equal to height H2.

Arm 140 may have a first end at vertical conductive structure 142 and an opposing second end facing phased antenna array 42. Arm 140 may have a length 126 (e.g., extending from the first end to the second end). The end of arm 140 facing phased antenna array 42 may be separated from the edge of patch element 60 facing side 106 of module 110 by distance 124. Portion 144 of ground traces 98 may have a length equal to the sum of distance 124 and length 126. Distance 124 may, for example, be approximately equal to (e.g., within 10-20% of) one-half of the free space wavelength of operation of antenna 40 (e.g., a centimeter or millimeter wavelength corresponding to a frequency between 10 GHz and 300 GHz).

The dimensions of passive resonator 138 may be selected to configure passive resonator 138 to resonate at approximately one-quarter of the effective wavelength of operation of antenna 40. The effective wavelength is given by dividing the free space wavelength of operation of antenna 40 by a constant factor (e.g., the square root of the dielectric constant of the material used to form antenna layers 84). Length 126 may, for example, be selected to be approximately (e.g., within 10-20% of) one-quarter of the effective wavelength of operation of antenna 40 in order to configure passive resonator 138 to exhibit this resonance. This resonance may create an infinite (open circuit) impedance at the wavelength of operation of antenna 40. The infinite impedance may serve to block surface currents I (e.g., surface currents at the wavelength of operation of antenna 40) from propagating out of antenna layers 84 at side 106 and into transmission line layers 86 of module 110 (e.g., as shown by arrow 122). In this way, passive resonator 138 may prevent surface current I from leaking onto RFIC 90 and producing undesirable feedback at the amplifier circuitry in RFIC 90.

The example of FIG. 8 is merely illustrative. If desired, passive resonator 138 may have other shapes (e.g., shapes having curved and/or straight edges). Passive resonator 138 may be entirely embedded within antenna layers 84 if desired (e.g., substrate 80 may extend to the right beyond passive resonator 138). In the example of FIG. 8, passive resonator 138 is shown as extending in only first and second dimensions (e.g., parallel to the Y and Z axes). In practice, passive resonator 138 may also extend in a third dimension (e.g., across the width of substrate 80 and parallel to the X-axis of FIG. 8).

Figure 9:
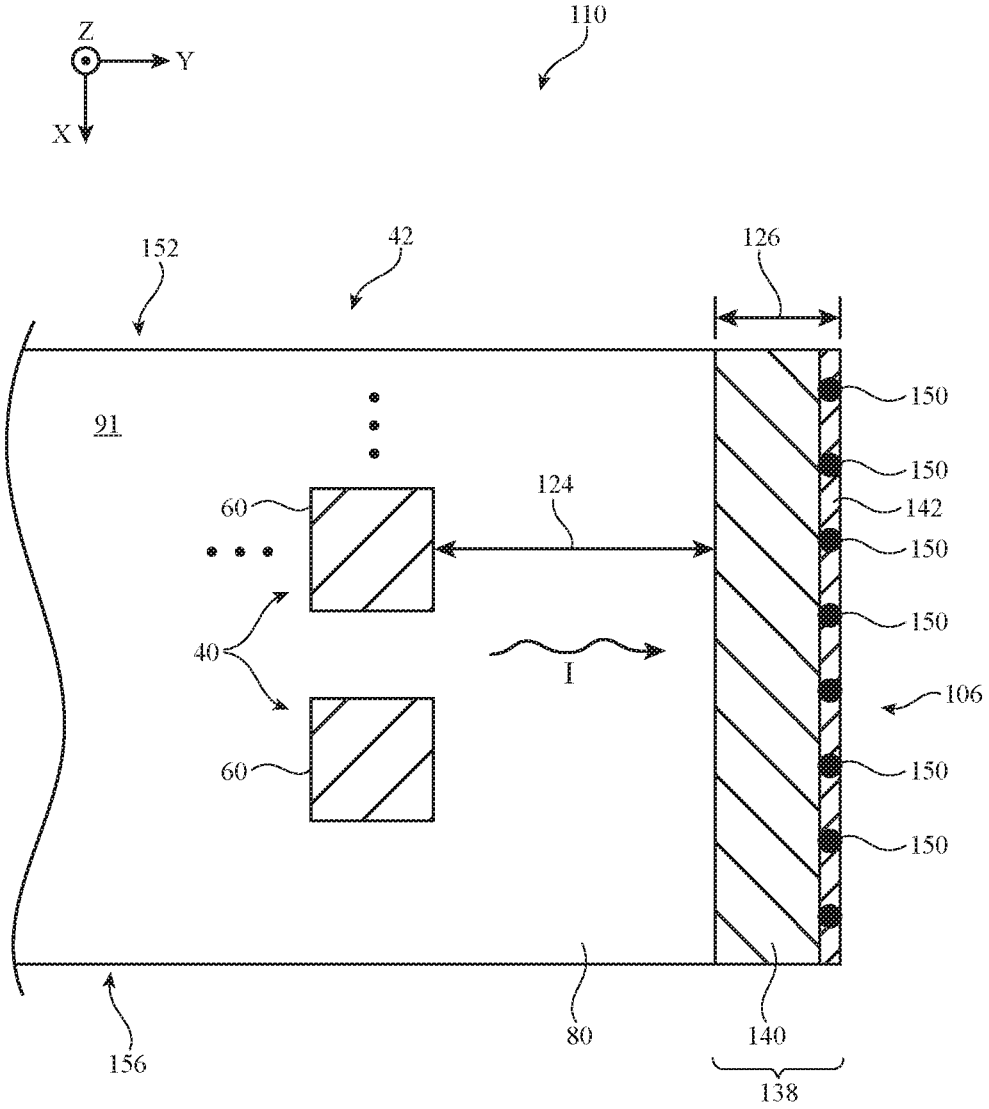
FIG. 9 is a top-down view of an illustrative antenna module having a passive resonator isolation element in accordance with some embodiments.

FIG. 9 is a top-down view of module 110 showing how passive resonator 138 may extend across the width of module 110. As shown in FIG. 9, phased antenna array 42 may include multiple antennas 40 having respective patch elements 60 formed at, on, or under surface 91 of substrate 80. Vertical conductive structure 142 of passive resonator 138 may cover side 106 of substrate 80 from edge 156 to edge 152 (e.g., vertical conductive structures 142 may extend across the width of module 110 from edge 156 to edge 152). Similarly, arm 140 of may extend across the width of module 110. Arm 140 may be separated from the nearest antennas 40 in phased antenna array 42 by distance 124. Arm 140 may have length 126 (e.g., parallel to the Y-axis of FIG. 9). Surface current I generated by phased antenna array 42 may encounter an infinite impedance at its wavelength due to the resonance of passive resonator 138, which serves to prevent current I from scattering at side 106 of module 110 and into the transmission line layers of module 110.

If desired, vertical conductive structure 142 may be formed from a fence of conductive vias 150 extending through substrate 80. Conductive vias 150 may be opaque at the wavelength of operation of phased antenna array 42. In order to be opaque at the frequencies covered by phased antenna array 42, the distance (pitch) between adjacent conductive vias 150 may be less than about ⅛ of the effective wavelength of operation of phased antenna array 42.

Figure 10:
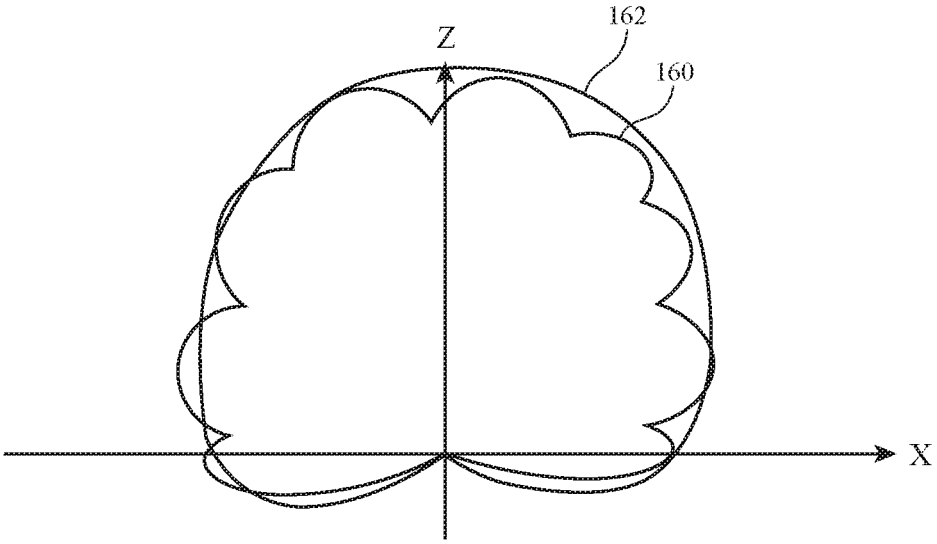
FIG. 10 is a side view of illustrative radiation pattern envelopes for a phased antenna array in accordance with some embodiments.

FIG. 10 is a side view of exemplary radiation pattern envelopes that may be exhibited by phased antenna array 42 in the presence and absence of passive resonator 138 of FIGS. 8 and 9. As shown in FIG. 10, curve 160 shows one possible radiation pattern envelope for phased antenna array 42 in the absence of passive resonator 138. As shown by curve 160, feedback generated at amplifier circuitry 92 by surface current I (e.g., as shown by arrows 104 of FIG. 7) may degrade the radio-frequency performance of module 110 such that phased antenna array 42 exhibits an uneven pattern envelope having undesirable nulls at different beam angles. Curve 162 illustrates one possible radiation pattern envelope for phased antenna array 42 when provided with passive resonator 138. As shown by curve 162, phased antenna array 42 may exhibit a relatively smooth (uniform) radiation pattern envelope across its field of view (e.g., because RFIC 90 of FIG. 7 is isolated from surface current I by passive resonator 138 of FIGS. 8 and 9). The example of FIG. 10 is merely illustrative. In general, curves 162 and 160 may have other shapes.

The foregoing is merely illustrative and various modifications can be made by those skilled in the art without departing from the scope and spirit of the described embodiments. The foregoing embodiments may be implemented individually or in any combination.

What is claimed is:

1. An antenna module comprising:

a dielectric substrate having transmission line layers and antenna layers;

a ground plane that separates the transmission line layers from the antenna layers;

an antenna resonating element on the antenna layers;

radio-frequency circuitry mounted to a surface of the transmission line layers and coupled to the antenna resonating element;

a radio-frequency connector mounted to the surface of the transmission line layers and coupled to the radio-frequency circuitry by a conductive trace in the transmission line layers; and a passive resonator on the antenna layers and coupled to the ground plane, wherein the passive resonator is configured to block surface current generated on the ground plane by the antenna resonating element.

2. The antenna module defined in claim 1, wherein the passive resonator comprises an arm formed from a conductive trace on a given one of the antenna layers and a vertical conductive structure extending from the arm to the ground plane.

3. The antenna module defined in claim 2, wherein the arm has a length that is within 10-20% of one-quarter of an effective wavelength of operation of the antenna resonating element.

4. The antenna module defined in claim 3, wherein the passive resonator is configured to form an infinite impedance at the effective wavelength of operation of the antenna resonating element.

5. The antenna module defined in claim 3, wherein the arm is separated from the antenna resonating element by one-half of a free space wavelength of operation of the antenna resonating element.

6. The antenna module defined in claim 3, wherein the antenna layers comprise ceramic.

7. The antenna module defined in claim 3, wherein the effective wavelength of operation corresponds to a frequency between 10 GHz and 300 GHz.

8. The antenna module defined in claim 2, wherein the vertical conductive structure comprises a structure selected from the group consisting of: conductive tape, sheet metal, conductive traces, and a fence of conductive vias.

9. The antenna module defined in claim 2, wherein the arm and the vertical conductive structure each extend across a width of the antenna module.

10. The antenna module defined in claim 1, wherein the radio-frequency circuitry comprises amplifier circuitry.

11. The antenna module defined in claim 7, wherein the radio-frequency circuitry comprises an integrated circuit.

12. An electronic device comprising:

a dielectric substrate;

a phased antenna array on the dielectric substrate and configured to convey radio-frequency signals at a frequency between 10 GHz and 300 GHz, wherein the phased antenna array comprises ground traces in the dielectric substrate;

a radio-frequency connector located on a surface of the substrate; and a passive resonator on the dielectric substrate and coupled to the ground traces, wherein a portion of the ground traces is interposed between the passive resonator and the radio-frequency connector.

13. The electronic device defined in claim 12, wherein the passive resonator is configured to form an open circuit impedance at the frequency.

14. The electronic device defined in claim 12, further comprising amplifier circuitry mounted to the surface of the substrate and configured to adjust a magnitude of the radio-frequency signals conveyed by the phased antenna array.

15. The electronic device defined in claim 14 further comprising conductive traces in the dielectric substrate that couple the radio-frequency connector to the amplifier circuitry.

16. The electronic device defined in claim 12, wherein the passive resonator is configured to resonate at one-quarter of an effective wavelength corresponding to the frequency.

17. The electronic device defined in claim 12, wherein the passive resonator is separated from a nearest antenna in the phased antenna array by one-half of a free space wavelength corresponding to the frequency.

18. The electronic device defined in claim 12, wherein the passive resonator comprises a conductive trace and a fence of conductive vias in the dielectric substrate.

19. An antenna module comprising:

a dielectric substrate;

a ground plane in the dielectric substrate;

a radio-frequency integrated circuit mounted to a surface of the dielectric substrate at a first side of the ground plane;

a phased antenna array having antenna resonating elements on the dielectric substrate at a second side of the ground plane, the antenna resonating elements being configured to convey radio-frequency signals at a frequency; and a conductive trace on the dielectric substrate at the first side of the ground plane and coupled to the ground plane by a vertical conductive structure, wherein the conductive trace is configured to resonate at one-quarter of an effective wavelength corresponding to the frequency.

20. The antenna module defined in claim 19, wherein the frequency comprises a frequency between 10 GHz and 300 GHz and the conductive trace is configured to block surface current generated at the first side of the ground plane by the phased antenna array from scattering onto the second side of the ground plane.

* * * * *